US007252284B2

(12) United States Patent
Takeuchi

(10) Patent No.: US 7,252,284 B2
(45) Date of Patent: Aug. 7, 2007

(54) BANKNOTE MOVING UNIT FOR A BANKNOTE STORING UNIT

(75) Inventor: Toru Takeuchi, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 291 days.

(21) Appl. No.: 11/042,035

(22) Filed: Jan. 25, 2005

(65) Prior Publication Data

US 2005/0189702 A1 Sep. 1, 2005

(30) Foreign Application Priority Data

Jan. 26, 2004 (JP) ..... 2004-016616

(51) Int. Cl.
*B65H 29/44* (2006.01)

(52) U.S. Cl. ..... 271/181; 271/177; 271/180

(58) Field of Classification Search ..... 271/177, 271/180, 181

See application file for complete search history.

(56) References Cited

U.S. PATENT DOCUMENTS 4,759,448 A * 7/1988 Kawabata ..... 209/551

6,698,751 B2 3/2004 Allen et al.

FOREIGN PATENT DOCUMENTS

JP 01-256463 10/1989

JP 07-220137 8/1995

* cited by examiner

*Primary Examiner*—Patrick Mackey
*Assistant Examiner*—Kaitlin S Joerger

(57) ABSTRACT

A banknote storing system for providing an economical and space-efficient storage of banknotes of various sizes in a removable banknote storage unit is provided. A banknote transporting unit can move a banknote with a movable elongated belt unit to a position over a gap position on the removable banknote storage unit. The slider unit in the banknote storage unit can move relative to a movable elongated bank unit for forcing the banknote unit into a storage area. The slider unit can form a pair of U-shaped channels that are positioned above the gap for laterally receiving the banknote when transported by the movable elongated belt unit.

7 Claims, 9 Drawing Sheets

BANKNOTE MOVING UNIT FOR A BANKNOTE STORING UNIT

BACKGROUND OF THE INVENTION

1. Field of the Invention

The present invention is related to a banknote moving unit for a banknote storing unit which is detachable from a banknote receiving unit. A banknote which is received by the banknote receiving unit is moved into a storing section to store the banknotes. More specially, this invention is related to a banknote moving unit for a small-size banknote storing unit that is capable of storing mixed different widths of banknotes.

2. Description of Related Art

In the storing of banknotes, it has been known to provide a pair of guiding boards located in a face-to-face relationship with a pair of parallel transporting sections. A middle section of a banknote can be held by the transporting section and a banknote holder. Both ends of the banknote are moved by the guiding boards which can move at a right angle to the banknote surface. The banknote is moved to the reverse side of the guiding board, and the banknote is stored in a storing section.

It has also been known to have both ends of a received banknote moved along by a banknote pushing device which is located in parallel relationship. The banknote pushing device is moved at a right angle to the banknote surface. The middle section of the received banknote is held by a banknote falling plate which is located between a pair of banknote pushing devices and a banknote placing holder, and then subsequently the banknote pushing devices are moved so that both ends of the banknote are moved into a storing section.

In Japanese Laid-Open Patent 01-256463, the guiding boards are a flat plate and can be moved into a box which is the storing section. The banknote is transported by the friction of a transporting section which is located between the guiding boards. When the banknote is positioned slantwise, the end of the banknote can be nipped between the guiding board and the wall of the box to move the guiding boards and may not be moved to the storing section.

In Japanese Patent 3382698, the banknote is moved by a banknote pushing member which moves a predetermined distance; afterwards the banknote is stored between a banknote falling plate and a banknote pushing member. As a result, the apparatus must be of a sufficient size. The prior art is still seeking an efficient small structure that can accommodate various size banknotes.

SUMMARY OF THE INVENTION

A first purpose of the present invention is to provide a banknote moving unit in which the banknote isn't nipped by a moving member and a wall. A second purpose of this invention is to provide a banknote moving unit which can be relatively miniaturized for a banknote storing unit. A third purpose of this invention is to provide a banknote moving unit where difference width banknotes can be stored. A fourth purpose of this invention is to guide the banknote with a controlled smooth motion by the transporting unit while having contact with the moving member.

The present invention is structured as follows. A banknote moving unit for a banknote storing unit includes a middle section of a received banknote held between a banknote transporting unit and a banknote pushing unit. Both ends of the received banknote are moved by a pair of moving bodies which move at a right angle to the received banknote, wherein the received banknote is moved into a storing section. The moving bodies include holding sections which are enclosed at three sides in a channel-like shape in a cross-section. The middle section is held by a transporting unit and both ends of the received banknote are moved by the moving bodies.

With this structure, both end sections of the banknote are guided by three surfaces of the holding section and are transported by the banknote transporting unit. If a banknote is positioned in a slanted manner, the banknote can't go to the outside of the holding section, because the holding section is enclosed in three sides like a channel section. In other words, both ends of the banknote aren't nipped between the moving body and the fixed wall. Therefore, the received banknotes are moved into the storing section and are stored. Also the middle section of the banknote is held by the banknote transporting unit and the banknote pushing unit. Therefore, the banknote isn't displaced towards the side. As a result, banknotes which are different in width can be stored.

This invention is desirable, because a transporting section of a transporting body of the banknote transporting unit and guiding surfaces of the moving body are located on a straight line. In this structure, the guiding surface of the moving bodies which are guiding both ends of the banknote and the transporting section of the transporting body which has contact with the banknote in friction are located in alignment. Therefore, contacting pressure which corresponds to at least a thickness of the banknote occurs at a contacting section between the banknote and the transporting section and the banknote is transported by the contacting pressure. In other words, the amount of bending of the banknote by the guiding surface and the transporting section is smaller. The friction resistance from the fixed guiding surface is also smaller. As a result, the banknote can be transported smoothly. Also, because the difference between the guiding surface and the transporting section is minimal, the apparatus is small.

When the transporting section is driven, the transporting section which is face-to-face to the guiding section of the moving bodies is slightly loose. Accordingly, the transporting section is looser, when it's not driven. In other words, the transporting section can slightly move towards the guiding surface. Therefore, the contacting pressure between the transporting section and the banknote can slightly increase. Also, the strength of the banknote and the contacting pressure is balanced naturally, because the transporting section is relatively loose. Therefore, the banknote can be smoothly transported, because any friction resistance from the guiding surface to the banknote is smaller.

A banknote moving unit for a banknote storing unit includes a middle section of a received banknote held between a banknote transporting unit and a banknote pushing unit. Both ends of the received banknote are moved by a pair of moving bodies which move at a right angle to the received banknote, wherein the received banknote is moved into a storing section. The transporting unit includes a pair of belts as the moving bodies and guiding sections which are enclosed at three sides to form a channel-like shape in cross-section at both sides of the banknote transporting unit, wherein both ends are transported by the belts.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
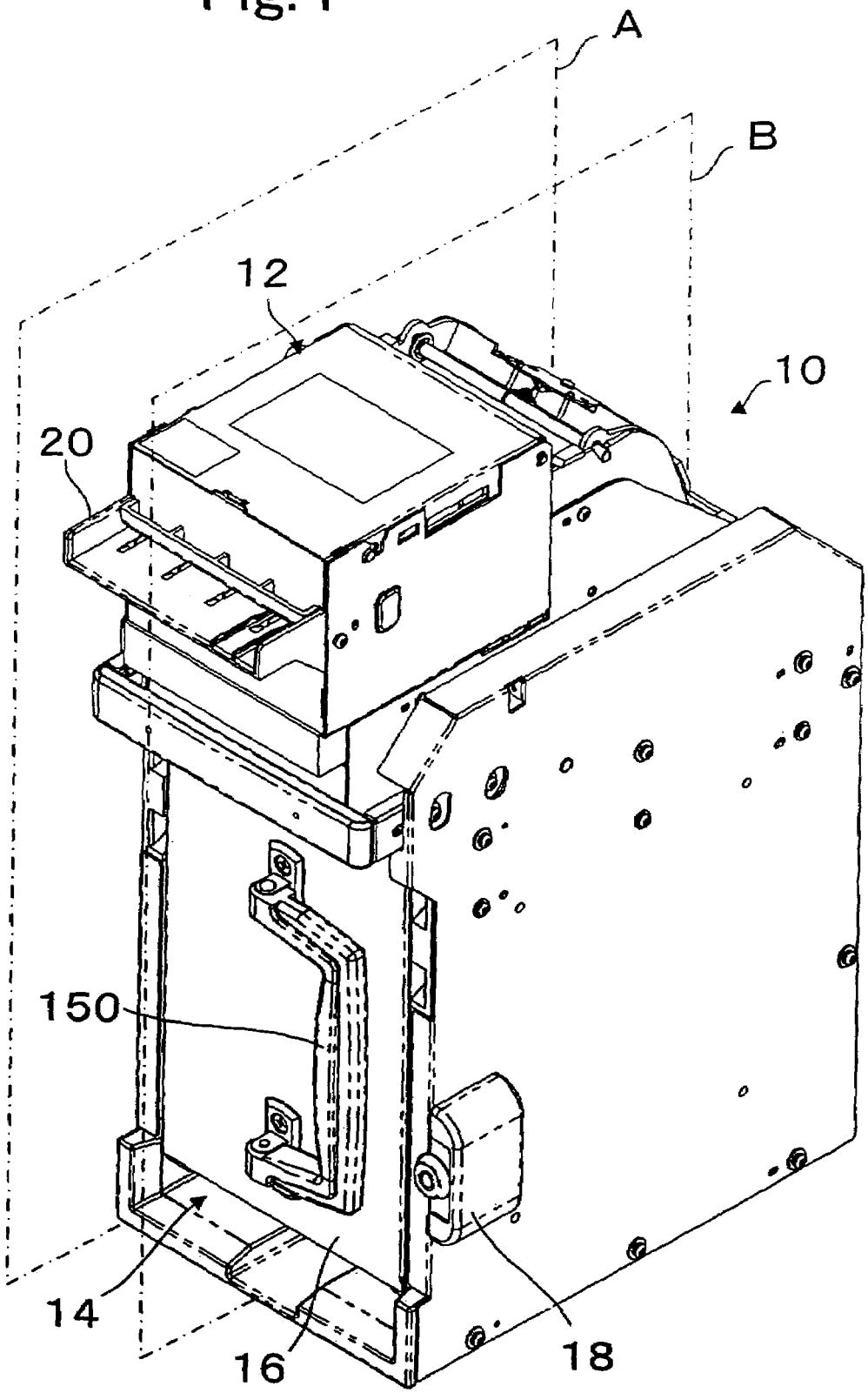
FIG. 1 is a perspective view of a situation where the banknote moving unit which is built in the banknote storing unit is attached to the banknote receiving unit.

As shown in FIG. 1, banknote receiving unit 10 includes banknote accepting unit 12 which is located at the front upper section, and a banknote storing unit 16 which is located in a safe space 14 which is located below the accepting unit 12. Banknote storing unit 16 is locked by locking unit 18 at banknote receiving unit 10. Banknote receiving unit 10 can be built in either vending machines, exchanging machines or other automatic machines. Also only the banknote guide 20 of banknote accepting unit 12 is located at the outside or exterior of the machine.

Figure 4:
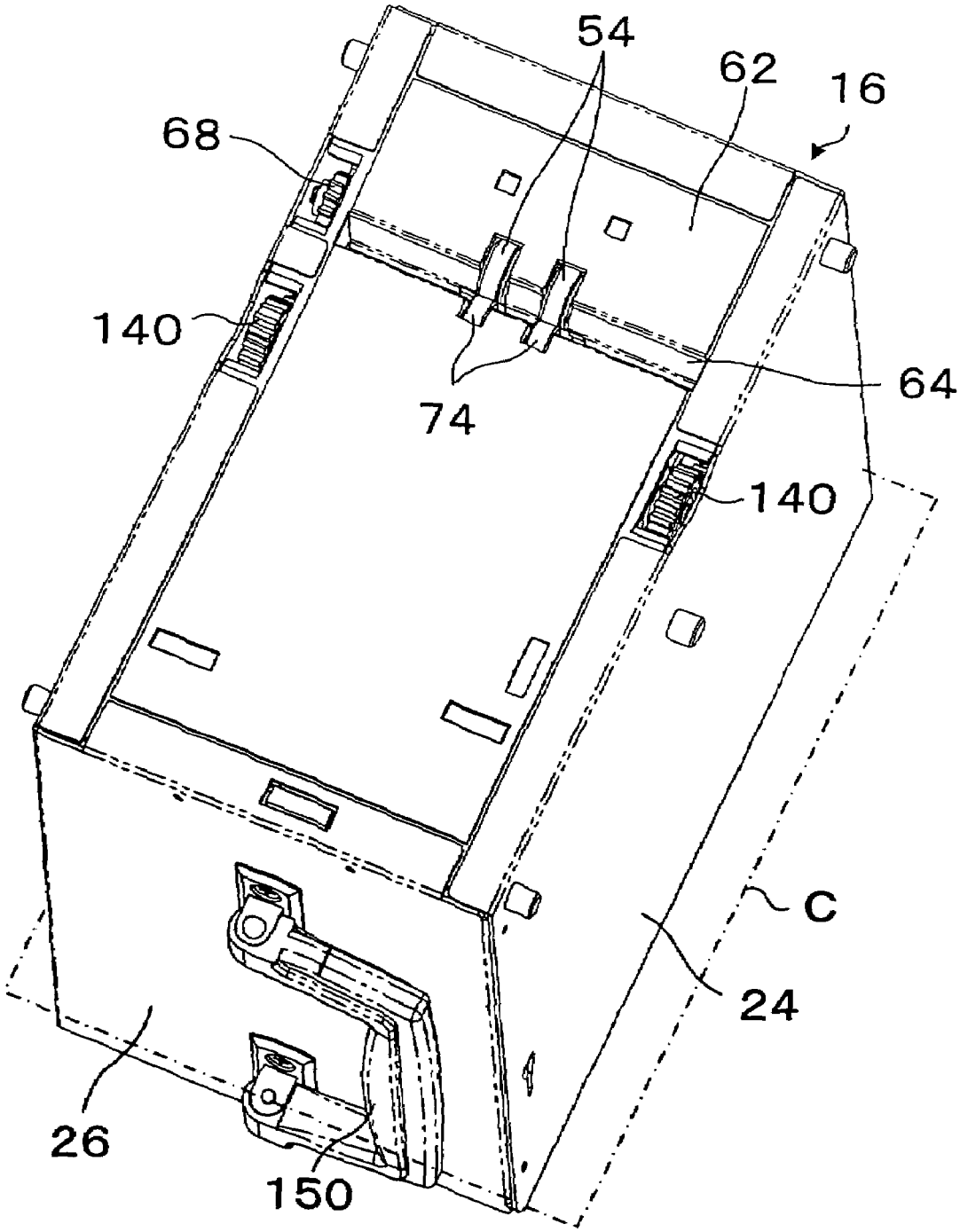
FIG. 4 is a perspective view from the banknote receiving slot where the banknote moving unit which is built in the banknote storing unit is attached to the banknote receiving unit.
Figure 5:
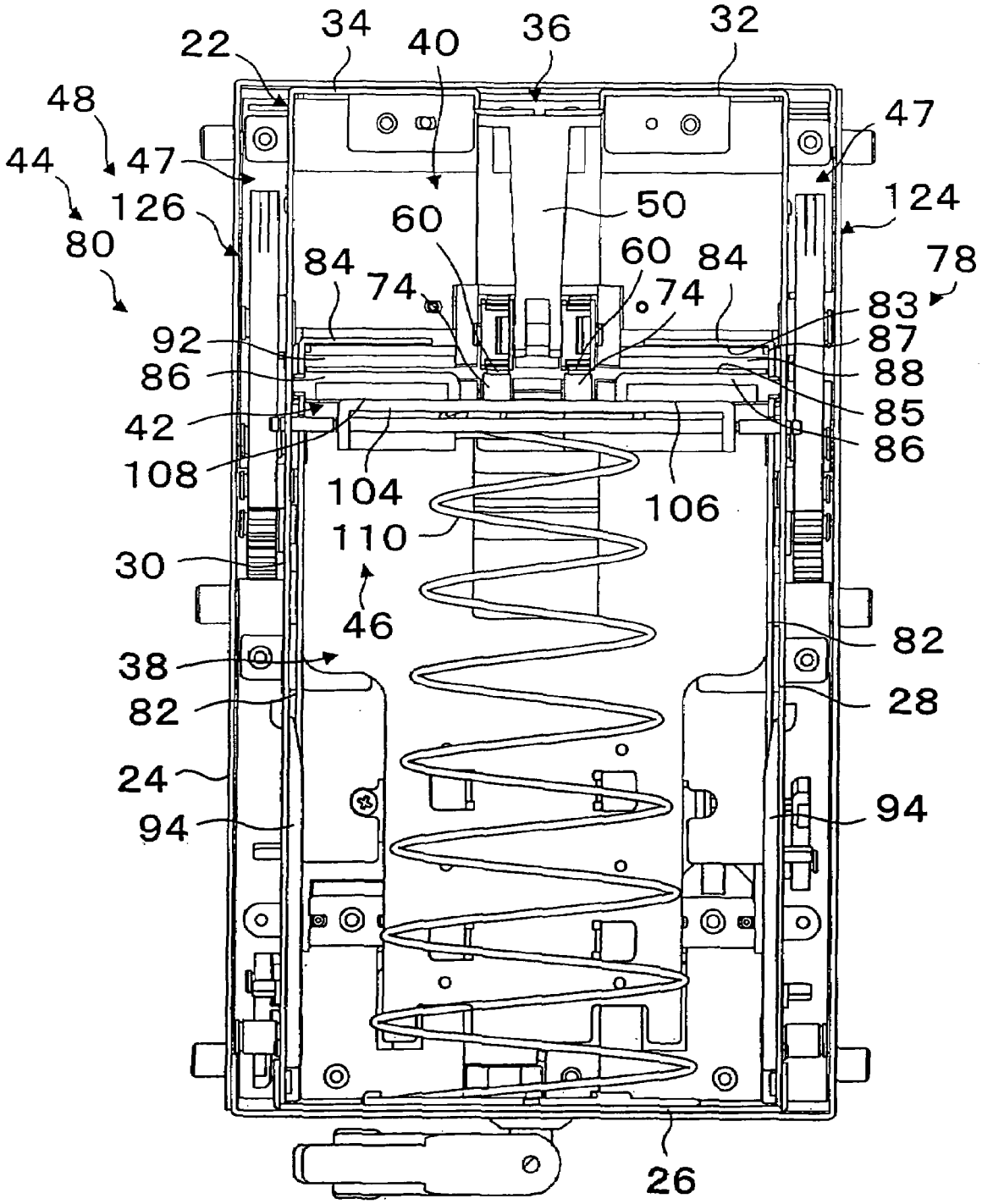
FIG. 5 is a cross-section view taken along the plane C in FIG. 4.
Figure 6:
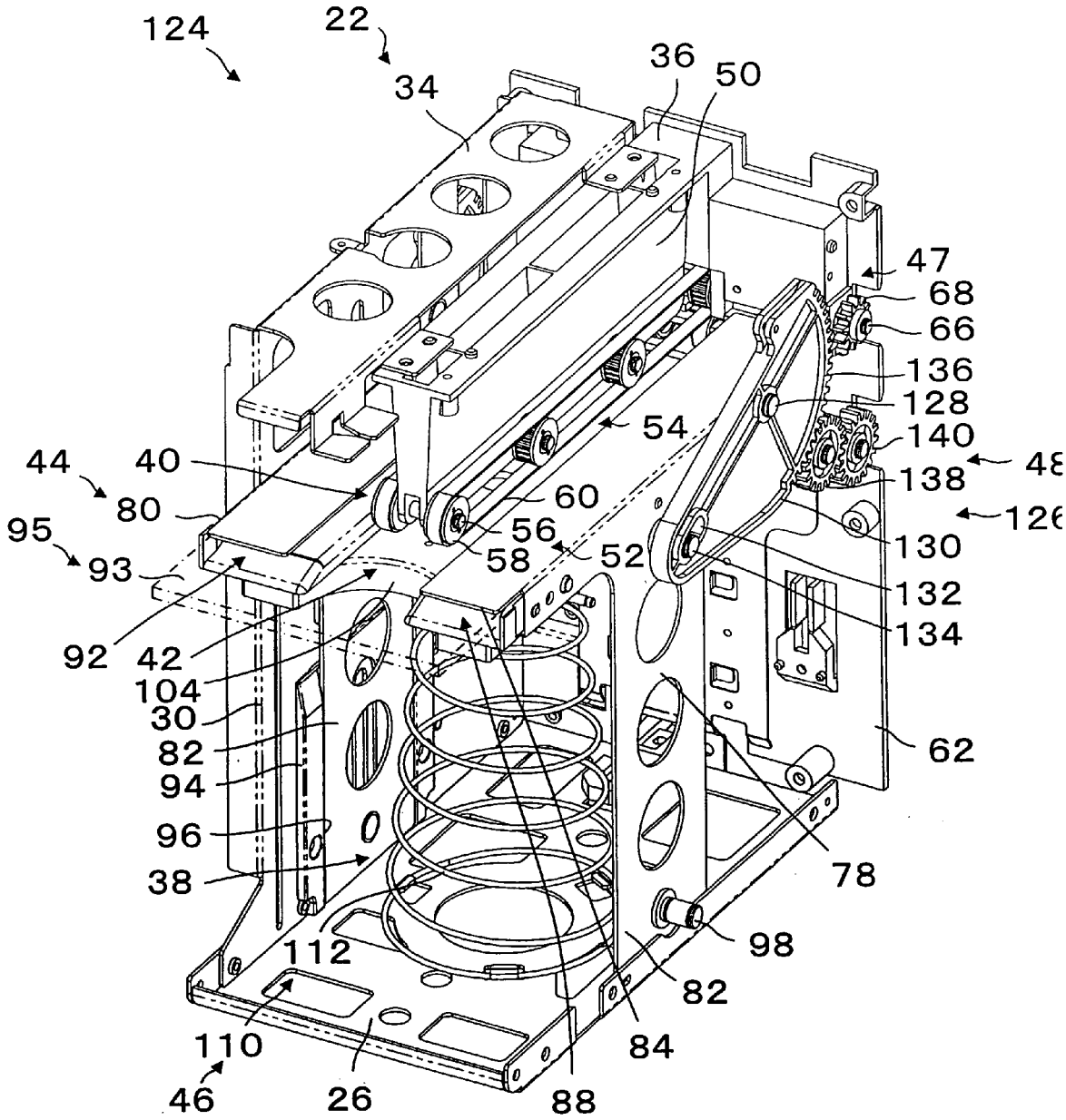
FIG. 6 is a perspective view of the banknote moving unit with the cover detached from the banknote storing unit.

Next, the structure of banknote storing unit 16 can be explained by referring to FIGS. 4-6. Banknote storing unit 16 includes a frame 22 which is made up of a sheet metal and is box-like in shape and cover 24 which is located outside the frame 22. Frame 22 is fitted into cover 24.

Next the structure of frame 22 is explained by referring to FIGS. 5 and 6. Also, FIGS. 5 and 6 are views from the reverse side; therefore, the left and the right in the explanation is opposite in the Figures. Left side wall 28 and right side wall 30 are located perpendicularly at both sides of a base 26 which is a flat plain plate. Left top plate 32 which is extended from the left side wall 28 and right top plate 34 which is extended from the right side wall 30 are located parallel to base 26 and their ends are located face-to-face and are spaced by a distance 36.

Banknote transported unit 40 which transports the banknotes into the interior, has a moving unit 44 which moves the transported banknote into storing section 42 and a pushing unit 46 which holds the banknotes are located at area 38 which is in turn enclosed by the base 26, side walls 28, 30, and top plates 32, 34. Driving unit 48 for driving moving unit 44 is located at driving unit area 47 which is narrow and is located between frame 22 and cover 24.

Next banknote transporting unit 40 is explained by referring to FIGS. 4, 5 and 6. An end of supporter 50 which is rectangular in shape is fixed at left top plate 32 and right top plate 34. Another end of supporter 50 extends towards storing section 42. Banknote transporting unit 40 is attached at the other end.

Banknote transporting unit 40 includes a pulley unit 52 and transporting body 54. Pulley unit 52 includes shaft 56 which is attached at supporter 50 and is rotatable and pulley 58 with teeth is fixed around shaft 56. Pulley 58 with inside surface integral teeth can be changed to a normal pulley with a V-groove. Plural pulley units 52 can be located along the longitudinal direction of supporter 50; in this embodiment four units are located for each belt.

Pulleys 58 which are located at both ends are wound by transporting body 54. The movement of transporting body 54 is limited by the pulleys 58 which are located in the middle, because the banknote has contact with the transporting body 54. Therefore, when the banknotes are transported every time, the middle pulley units 52 can optionally be removed. Pulley unit 52 which is located at an end is located at a receiving slot 64 which is a slit (see FIG. 3) and which is located at side wall 62 of storing unit 16. Shaft 66 extends into driving unit area 47. Driven gear 68 is fixed at the end of shaft 66.

Figure 2:
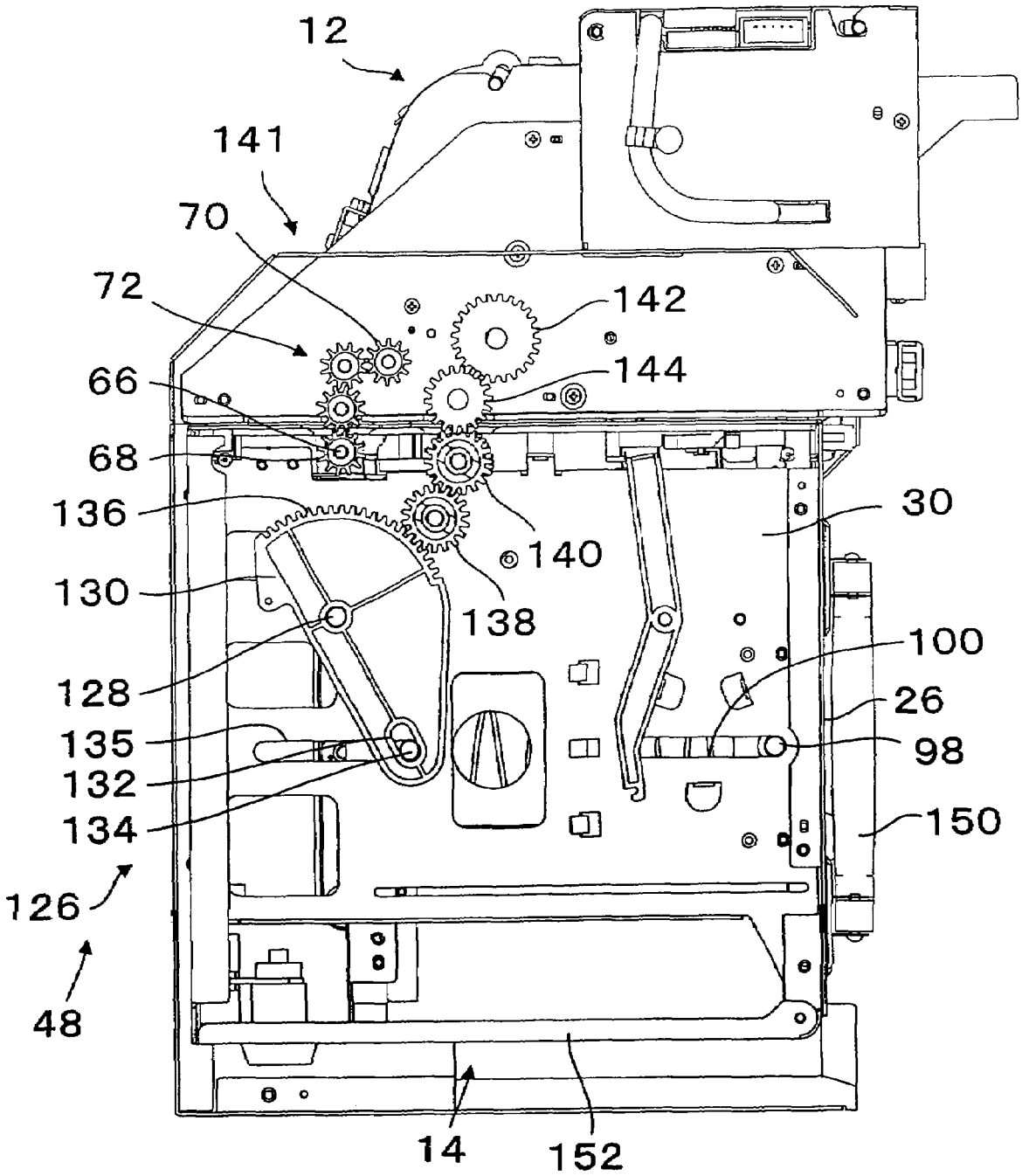
FIG. 2 is a cross-section view taken along the plane A in FIG. 1.

Driven gear 68 is connected to driving gear 70 which is driven by driving motor 71 (shown in FIG. 3) for transporting unit (not shown) of banknote accepting unit (12) through a transmission mechanism 72 as shown in FIG. 2. Transporting body 54 is an elongated endless belt unit with a tooth in this embodiment; however, it can be changed to either a plain belt, a rope or a member as a ring which is made from material that is flexible. In other words, transporting body 54 has a function to perform when it has contact with the banknote and transports the banknote in one direction. Transporting section 60 is the contacting section between transporting body 54 and the banknote. Roller 74 has resiliently contact with transporting body 54 which is wound around a pulley 52 which is located at the end.

Figure 3:
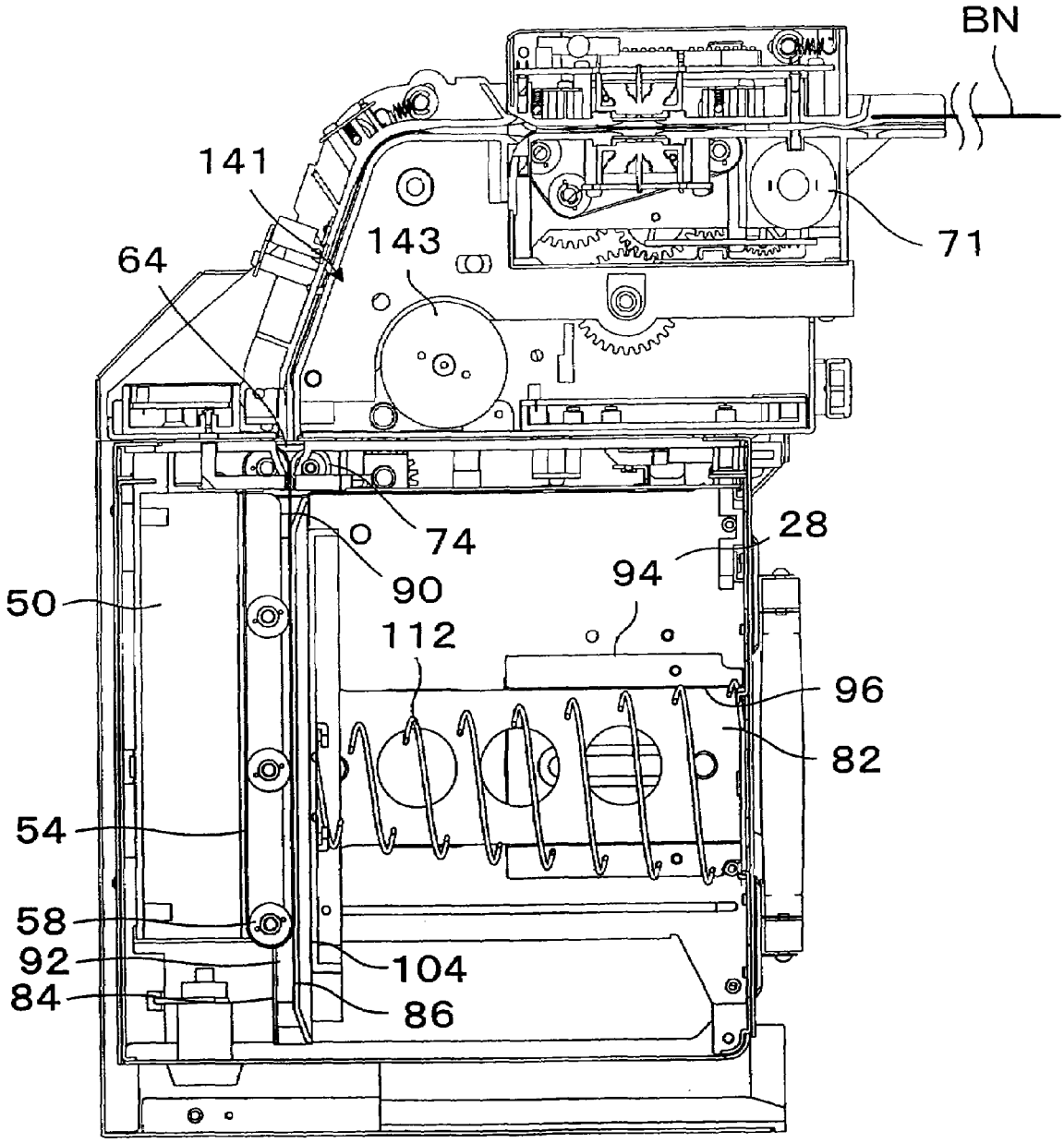
FIG. 3 is a cross-section view taken along the plane B in FIG. 1.

Therefore, an authenticated banknote which was been distinguished by a banknote accepting unit 12 is transported to receiving slot 64, and is held between transporting body 54 and roller 74; afterwards it is moved in the transporting direction (see FIG. 3). In other words, transporting section 60 which has initial contact with the banknote is loose or flexible and becomes tighter when driven. Accordingly, the banknote BN is transported into storing unit 16 and is moved to the moving direction of transporting section 60.

Transporting unit 40 is located at both sides of supporter 50 in a preferred embodiment, because the friction force increases on the banknote and adds friction to the banknote. Therefore, the banknote is moved in a parallel manner. The transporting unit 40 can be located at only one side of supporter 50; however, the width of transporting section 60 would be increased. Transporting unit 40 has a function where an authenticate banknote which was distinguished by banknote accepting unit 12 is transported into storing unit 16. Therefore, it can be optionally changed to another unit which has the same function.

Next, moving unit 44 is explained. Moving unit 44 includes left moving body 78 and right moving body 80 which are channel-like in shape and which are located beside transporting unit 40. Left moving body 78 and right moving body 80 are the same structure and are located in area 38, and are symmetrically arranged left and right to transporting unit 40. Therefore, only left moving body 78 is explained. Left moving body 78 includes slider section 82 and a first holding section 84 which is located at the end section of the slider section and which extends at a right angle to form a "T" shape.

First holding section 84 is bent at a right angle to slider section 82 and is located parallel to base 26; in other words, the drawn banknote. Second holding section 86, made from resin, is a plate fixed at slider section 82 and positioned away from the first holding section 84 at a predetermined distance and is located below the first holding section 84. Left holding section 88, which has a predetermined height and a predetermined width (shown in FIG. 5), is structured by lower surface 83 of first holding section 84, upper surface 85 of second holding section 86 and side surface 87 of slider section 82 at three sides. The height of left holding section 88 which is designed as small as possible within a range which can move the banknote smoothly is desirable, because banknote storing unit 16 is miniaturised.

Left holding section 88 can be changed to an F-like shape in unity with slider section 82 and is made from a resin material. Second holding section 86 has a predetermined thickness, so that when the banknote is curved by the transporting unit 40, the banknote doesn't contact with the section 86. Slanting surface 90 is located at the second holding section 86 to the side of receiving slot 64 and guides the banknote to the left holding section 88 (shown in FIG. 3). Right holding section 92 is also located at a right moving body 80.

Slider section 82 is inserted into a guiding groove 96 of guiding section 94 which is made from resin and which is fixed at the inner surface of left side wall 28, and slider section 82 is slidable in the longitudinal direction. In FIG. 6, slider section 82 is inserted into guiding groove 96 of guide 94 which is fixed at left side wall 28. Also, guiding pin 98 which projects towards the outside from the lower section of slider section 82 is inserted into an elongated hole 100 which is located at the right side wall 30 and is also slidable (the same as the left). Therefore, left moving body 78 and right moving body 80 are guided by guiding grooves 96 and elongated hole 100 and are reciprocated straight.

As shown in FIG. 3, when storing unit 16 is in a standby situation, left holding section 88 of left moving body 78 is located on an extending line of receiving slot 64. Right moving body 80 is located on the same as left moving body 78. Therefore, in the standby situation, left holding section 88 and right holding section 92 are located in a virtual plane 93 which is extended from receiving slot 64 (shown in FIG. 6). The left end and the right end of the banknote move into the left holding section 88 and into the right holding section 92. In this embodiment, virtual plane 93 is approximately perpendicular, as shown in FIG. 3. When the banknote moves in virtual plane 93, the banknote is also moved by gravity.

A sensor (not shown) detects the passing of the rear end of the received banknote at roller 74. Motor 71 is stopped based on a detecting signal, and the transporting of the banknote is stopped. Therefore, the banknote is stored temporarily in the situation where the left end and the right end are located at left holding section 88 and right holding section 92. In other words, virtual plane 93 is a temporary storing section 95 for the banknote. Also, left moving body 78 and right moving body 80 can be moved towards each other at a right angle to virtual plane 93.

Figure 9:
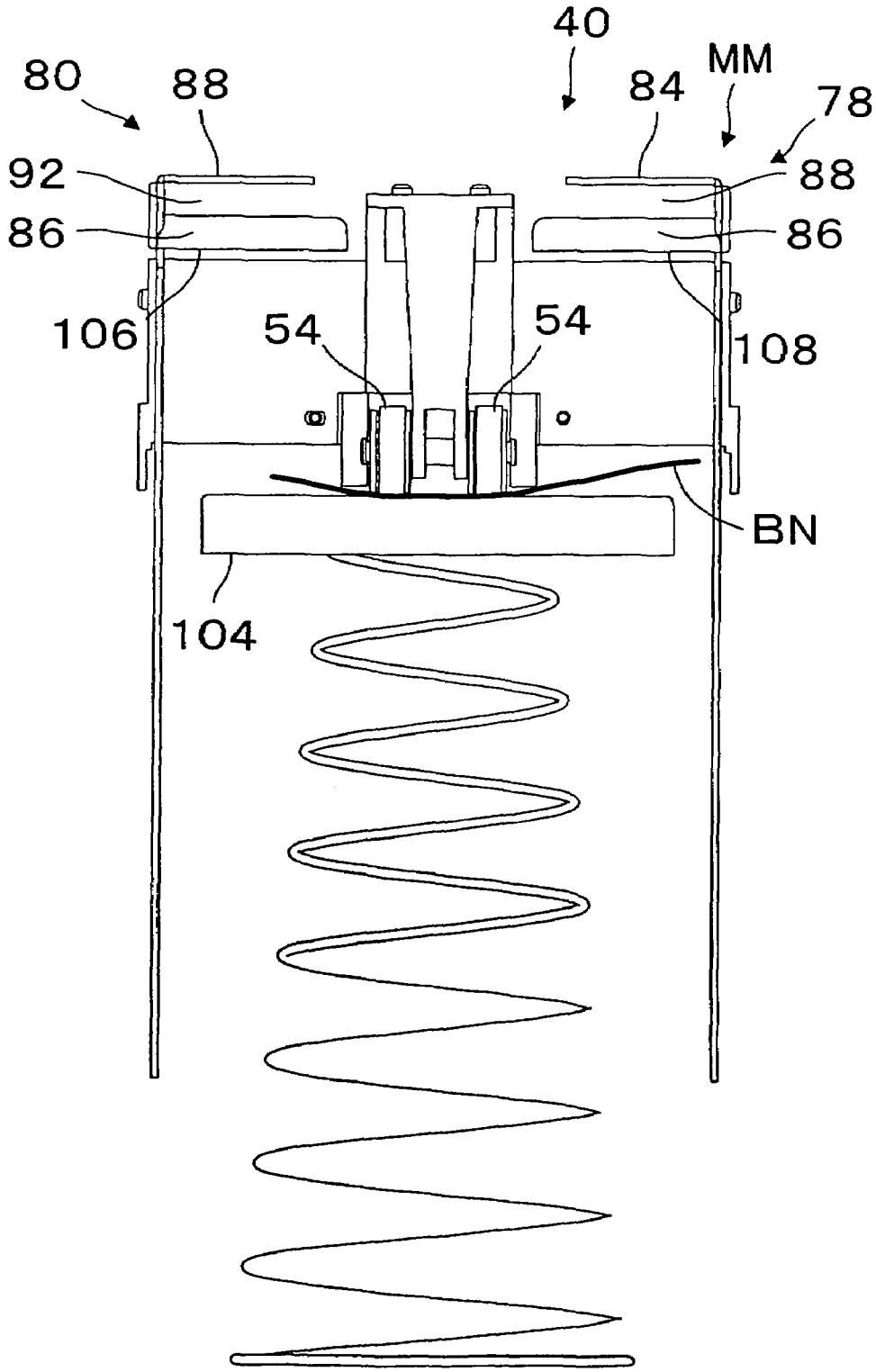
FIG. 9 is an explanatory schematic view (in maximum movement situation) of the banknote moving unit.

Therefore, moving unit 44 is movable along supporter 50 to moved position MM as the end of the banknote is located at the side of banknote pusher 104 than left reverse surface 106 and right reverse surface 108 of second holding section 86 (see FIG. 9). Transporting section 60 and upper surface 85 which form a guide path for the second holding section 86 for the banknote lie side-by-side together as shown in FIG. 5. In this structure, the banknote in storing unit 16 is moved into storing unit 16 by the friction of transporting section 60 only. As a result, the banknote receives only moderate friction from transporting section 60.

In other words, the banknote receives the transporting force on one face by the contacting to transporting section 60. Another face receives the braking force by upper surface 85 of second holding section 86. The braking force is decided based on the contacting area, the contacting pressure and the coefficient of sliding friction which are between the banknote and second holding section 86.

When transporting section 60 has initial contact with the banknote, the contact is loose and is side-by-side with upper surface 85 of second holding section 86 in a state of rest; transporting section 60 loosens in the driven situation of transporting unit 40. Accordingly, transporting section 60 is slightly moved towards second holding section 86. As a result, the contacting pressure which is between the banknote BN and transporting section 60 increases and the friction force reaches a desirable amount.

Therefore, when the position of the transporting section is adjusted for different denominations of banknotes, the standard is clear. As a result, adjusting is easy. Also, the contacting surface of transporting body 54 to the banknote is made from urethane rubber for getting a moderate amount of friction and durability. Moving unit 44 has a function where the banknote which is transported into storing unit 16 by transporting unit 40 moves into storing section 42. Therefore, moving unit 44 can be changed to another device which has the same function.

Next, the pushing unit 46 is explained. Pushing unit 46 includes a banknote holder 104 which has contact with the banknote and an urging body 110 which urges banknote holder 104 towards left moving body 78, left reverse surface 106 and right reverse surface 108 of right moving body 80. Banknote holder 104 is a plate and is movable between the left and the right sliding sections 82.

Urging body 110 is a spring 112 where the end of spring 112 is fixed at base 26 and another end is fixed at banknote holder 104. The spring force of urging body 110 is set up to be reduced as the piled-up height of banknotes increases for preventing the compression buckling of the banknotes. Also, the urging force is set up when both ends of the banknote which are held between storing section 42 and the stored banknotes are transported by moving unit 44; the banknote is held by transporting unit 40 and the stored banknotes. Therefore, urging body 110 can be changed to another device which has the same function.

Also, storing section 42 is an area which is enclosed by left reverse surface 106, right reverse surface 108, transporting section 60 and banknote holder 104. Therefore, when the banknotes aren't stored, banknote holder 104 has contact with left reverse surface 106 and right reverse surface 108.

Next, the structure of driving unit 48 is explained by referring to FIGS. 2 and 6. Driving unit 48 includes left driving unit 124 which is located at the left side wall 28 and right driving unit 126 which is located at the right side wall 30. Left driving unit 124 and right driving unit 126 have the same structure. Therefore, only right driving unit 126 is explained as shown in FIG. 2 on behalf of the driving units. Same reference numbers are attached on the same parts of left driving unit.

Oscillating body 130 can pivot on a fixed shaft 128 which protrudes from the right side wall 30 to driving area 47. Pin 134 which protrudes from sliding section 82 is inserted into elongated hole 132 which is located at an end of oscillating body 130, and pin 134 is slidable. Pin 134 is guided by elongated hole 135 of right side wall 30. Sector gear 136 is located at the other end section of oscillating body 130, and the center is located on the fixed shaft 128. Gears 138 and 140 are located at right side wall 30 and are rotatable. Sector gears 136 have been engaged with gears 142, 144 which are fixed at the output shaft of motor 143 (shown in FIG. 3) for storing the banknote through rotation of the gears 138 and 140.

When storing unit 16 is attached to safe area 14, gear 140 is engaged with gear 144. Therefore, when gear 142 rotates in the clockwise direction, oscillating body 130 pivots in the clockwise direction, and moving unit 44 is moved towards the banknote storing direction. When gear 142 rotates in the counter-clockwise direction, oscillating body 130 pivots in a counter-clockwise direction in FIG. 2, and moving unit 44 is moved to standby position SB (see FIG. 7).

Driving unit 48 has a function of causing the moving unit 44 to be moved to the virtual plane 93; in other words, at a right angle to the banknote by driving unit 48. Therefore, driving unit 48 can be changed to another unit which has the same function. Also, handle 150 for carrying banknote storing unit 16 is attached at an outer surface of base 26. As shown in FIG. 2, an end section of side wall 152 which is located face-to-face to side wall 62 of banknote storing unit 16 pivots at frame 22, and can open for the removing the banknotes which are stored in storing section 42.

Figure 7:
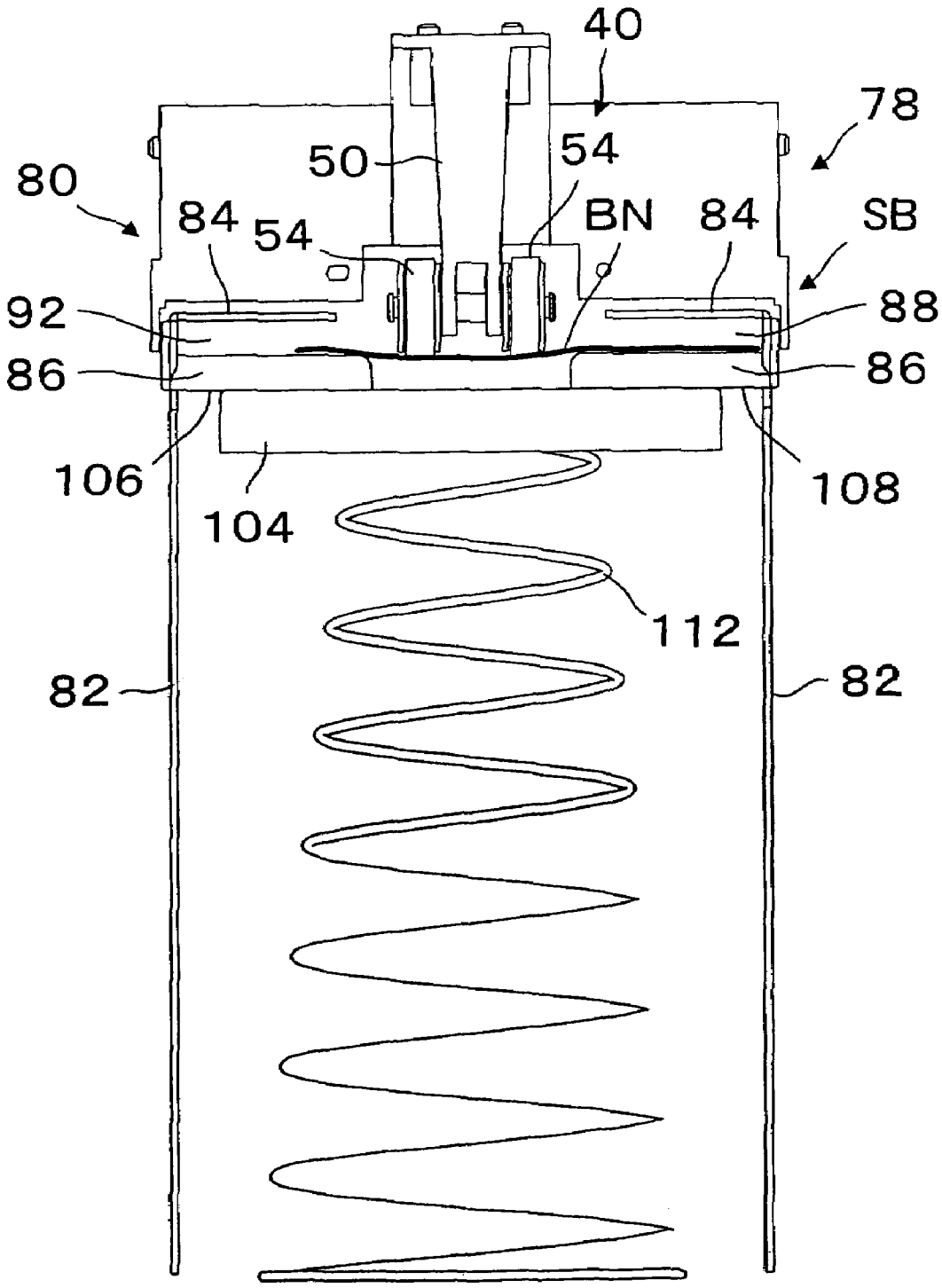
FIG. 7 is an explanatory schematic view (in standby situation) of the banknote moving unit.
Figure 8:
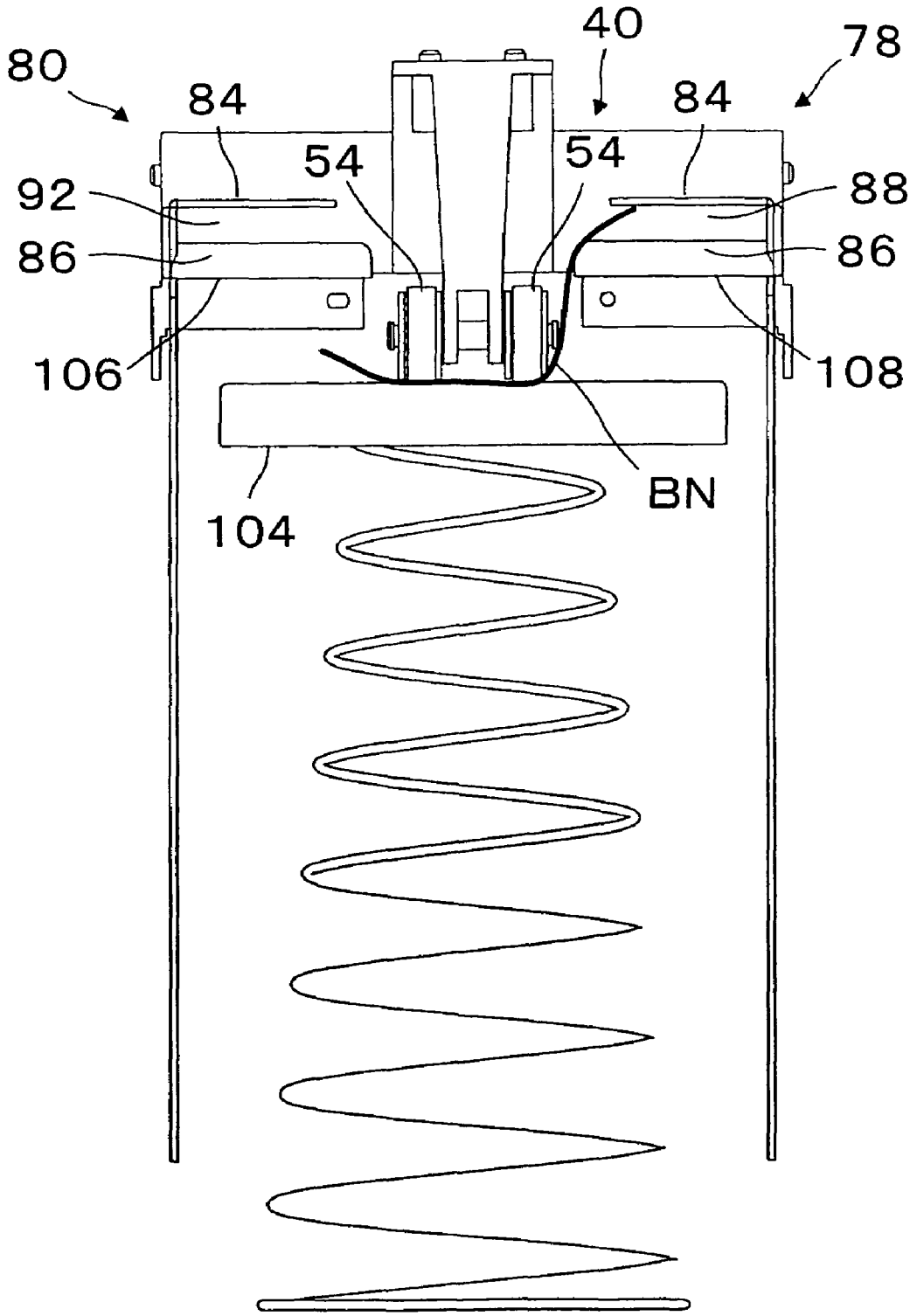
FIG. 8 is an explanatory schematic view (in moving process) of the banknote moving unit.

Next the operation of this embodiment is explained by referring to FIGS. 7-9. Storing unit 16 is stored at a position in safe space 14; afterwards a power switch (not shown) is turned on. When moving unit 44 isn't detected at standby position SB by the position sensor (not shown), control unit (not shown) operates motor 143. Accordingly, gear 142 rotates in the counter-clockwise direction in FIG. 2. Also oscillating body 130 is pivoted in the same direction.

Therefore, sliding section 82 is moved through pin 134; in other words, moving unit 44 is moved towards the right as shown in FIG. 3 and goes to standby position SB (shown in FIG. 7). When moving unit 44 is moved to the standby position SB, it is detected by the position sensor (not shown). Motor 143 is stopped based on a detection signal. Therefore, the rotation of gear 142 is stopped, and it goes to the standby mode.

In this standby situation, left holding section 88 of left moving body 78 and right holding section 92 of right moving body 80 are located under receiving slot 64 and are extended downwards and perpendicular as shown in FIG. 3. When banknote BN is inserted along the left side wall of banknote guide 12 shown in FIG. 1, banknote BN is detected by a sensor (not shown), and motor 71 rotates.

The transporting unit (not shown) of banknote distinguishing unit 12 is operated by the rotation. Also driven gear 68 is rotated by motor 71 through driving gear 70 and transmitting mechanism 72. Accordingly, shaft 66 rotates, and banknote BN is transported into a temporary storing section 95. When banknote BN is distinguished as authenticate by accepting unit 12, the banknote BN is transported to receiving slot 64, and the end is held between transporting body 64 and roller 84.

Therefore, banknote BN is transported into temporary storing section 95 by transporting body 54 and roller 74 and is drawn into the temporary storing section 95 by the friction contact with transporting section 60. As a result, the banknote BN doesn't jam. In this process, transporting section 60 which has contact with banknote BN is let off by pulley 58.

In other words, the transporting section 60 is slightly loose, and the position slightly moves towards second holding section 86. Therefore, the contacting force between banknote BN and transporting section 60 increases. As a result, the friction force between banknote BN becomes sufficient. Also, transporting section 60 which has contact with banknote BN is on the loose side of transporting body 54. Therefore, the transporting section can bend in banknote BN. As a result, the contacting force is not over a predetermined quantity. Therefore, damage isn't caused to the banknotes BN.

The left end section of moving banknote BN is located in the left holding section 88, and is guided by lower surface 86 of first holding section 84, upper surface 85 of second holding section 88 and side surface 87 of sliding section 82. In this process, the left end section of banknote BN is enclosed in three sides. Therefore, the left end section doesn't go into gaps which are made up between other parts. On the other hand, the right end section of banknote BN moves into the right holding section 92 of right moving body 80. When a width is different such as by denomination, the right end section of the narrow width banknote is guided by lower surface 83 of first holding section 84 of right holding section and upper surface 82 of second holding section 86.

In this situation, lengths of the banknote which are located at the left and the right of transporting unit 40 are different. Therefore, the contacting area between the left end section and first holding section 84 and the contacting area between the right end section and second holding section 86 are different. Accordingly, the banknote BN receives a rotating force; however, the left end section is guided by side surface 87 of sliding section 82. As a result, the banknote BN doesn't slant. Immediately the rear end of banknote BN is passed through roller 74, and it is detected by a sensor (not shown), and motor 71 is stopped.

By this procedure, received banknote BN is stored in temporary storing section 95 (shown in FIG. 7). Next, motor 143 rotates and gear 142 rotates in the clockwise direction. Therefore, oscillating body 130 pivots in the clockwise direction about the center of fixed shaft 128 shown in FIG. 2 through sector gear 136. As a result, sliding section 82 is moved towards the left through pin 134 shown in FIG. 2 and FIG. 8.

Guiding groove 96 and guiding pin 98 are guided by elongated hole 100 and pin 134 is guided along elongated hole 135. Therefore, sliding section 82 is moved forward at a right angle direction to temporary storing section 95. In other words, left moving body 78 and right moving body 80 are moved in a unified manner, and pass through the side of transporting unit 40, and afterwards it moves along supporter 50. In this process, the middle of banknote BN is held at a predetermined force by transporting unit 40 and banknote holder 104.

Afterwards, left moving body 78 and right moving body 80 move towards left top board 32 and right top board 34. The left and the right end sections of banknote BN move relatively to left moving body 78 and right moving body 80. In this process, the right end side of banknote BN, which is shorter, falls off second holding section 86 of right moving body 80.

Left moving body 78 and right moving body 80 move to the positions MM which are located near the left top board 32 and right top board 34. Therefore, the left end section of banknote BN is released from second holding section 86 of left moving body 78 (shown in FIG. 9). When a maximum width banknote is used, the left and the right end sections run off from left moving body 78 and right moving body 80 at approximately the same time. Accordingly, the left and right ends of banknote BN move off left moving body 78 and right moving body 80, and afterwards banknote BN moves into storing section 42.

When moving unit 44 goes to moved position MM, the sensor (not shown) detects it. Motor 143 is stopped based on the detection and afterwards rotates in a counter direction. Therefore, gear 142 rotates in the counter-clockwise direction shown in FIG. 2. By this motion, oscillating body 130 pivots in the counter-clockwise direction, and goes to the standby position shown in FIG. 2. Moving unit 44 is moved from position MM shown in FIG. 9 to standby position SB shown in FIG. 7 by the pivoting. Therefore, a banknote BN which was moved into storing section 42 is held by the left reverse surface 106, right reverse surface 108 and banknote holder 104, and is accordingly stored.

In addition, words such as "up" and "down" and "left" and "right" are used as reference points for the user's convenience, but this present invention is not limited by such words because the temporary storing section 95 can be located at a slant or on the level.

This present invention can be used in a miniature banknote storing unit which is built into vending machines, gaming machines or automatic exchanging machines, etc.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A banknote storing system comprising:

a banknote transporting unit for moving a banknote to a storage position including a movable elongated belt unit for engaging a middle portion of a banknote;

a removable banknote storage unit for storing banknotes including a holding unit with an elongated gap of a size less than a width of the banknotes to be stored and a movable biased banknote holder to support stored banknotes, the movable elongated belt unit is relatively movable to the banknote storage unit and of a size to extend through the elongated gap during relative movement with the banknote storage unit whereby the elongated belt unit positions a banknote over the gap and while engaging the banknote extends through the gap to move the movable banknote holder until the banknote is released from the gap to flatten within the banknote storage unit and the movable elongated belt unit is removed through the gap to a standing position; and a drive unit to drive the elongated belt unit so that the elongated belt unit is more flexible when stationary and not driven.

2. The banknote storing system of claim 1 wherein the banknote storage unit includes a rotatable gear mounted on a wall of the banknote storage unit and a relatively movable slider unit positioned within the banknote storage unit and operatively connected to the holder unit, whereby movement of the rotatable gear provides relative movement of the holder unit and the elongated belt unit.

3. The banknote storage system of claim 2 wherein the slider unit forms a pair of U shaped channels that are positioned above the gap and laterally receive the banknote when transported by the movable elongated belt unit.

4. The banknote storing system of claim 3 wherein the elongated belt unit is held stationary as it extends through the gap during a storage mode of operation.

5. The banknote storing system of claim 1 wherein a pair of parallel belt units are provided to engage the middle portion of the banknote.

6. A banknote storing system comprising:

a banknote transporting unit for moving a banknote to a storage position including a pair of parallel movable elongated belt units for respectively engaging a middle portion of a banknote and a drive unit for driving the elongated belt units; and a removable banknote storage unit for storing banknotes including a slider unit with a guide and holding unit with an elongated gap of a size less than a width of the banknotes to be stored and a movable biased banknote holder to support stored banknotes, the movable elongated belt units are stationary relative to the banknote storage unit and of a size to extend through the elongated gap during relative movement with the banknote storage unit whereby the elongated belt units transport the banknote into the guide unit to position a banknote over the gap and, while engaging the banknote, extends through the gap to move the movable banknote holder until the banknote is released from the gap and guide and holding unit to flatten within the banknote storage unit and the movable elongated belt units are removed through the gap to a standing position in alignment with the guide and holding unit, wherein the drive unit drives the elongated belt units so that the elongated belt units are more flexible when stationary and not driven.

7. The banknote storing system of claim 6 wherein the banknote storage unit includes a rotatable gear mounted on a wall of the banknote storage unit operatively connected to the slider unit, whereby movement of the rotatable gear provides relative movement of the holder unit and the elongated belt units.

* * * * *